US005438786A

United States Patent [19]

Hilderbrand

[11] Patent Number: 5,438,786

[45] Date of Patent: Aug. 8, 1995

[54] PISTOL REST

[76] Inventor: Darrell P. Hilderbrand, 1151 Huron Trail, Jamestown, Ohio 45335

[21] Appl. No.: 164,535

[22] Filed: Dec. 10, 1993

[51] Int. Cl.[6] ..... F41A 23/14

[52] U.S. Cl. ..... 42/94; 248/171

[58] Field of Search ..... 42/94; 89/37.04, 40.06; 248/170, 171, 354.5

[56] References Cited

U.S. PATENT DOCUMENTS

| | | | |
|---|---|---|---|
| 575,529 | 1/1897 | Stephens | 248/171 |
| 3,225,656 | 12/1965 | Flaherty et al. | 89/37.04 |
| 3,516,200 | 6/1970 | Marin | 248/354.5 |
| 3,703,046 | 11/1972 | Barone et al. | 42/94 |
| 4,937,965 | 7/1990 | Narvdez | 42/94 |
| 5,333,829 | 8/1994 | Bell et al. | 42/94 |

FOREIGN PATENT DOCUMENTS

| | | | |
|---|---|---|---|
| 1155 | of 1890 | United Kingdom | 248/170 |
| 10303 | of 1909 | United Kingdom | 89/40.06 |
| 547257 | 8/1942 | United Kingdom | 89/40.06 |

OTHER PUBLICATIONS

Dickey, Pete, "Shooting Sticks Help", American Rifleman, vol. 130, No. 6, Jun. 1982, pp. 34–36, 70.

*Primary Examiner*—Stephen C. Bentley

[57] ABSTRACT

A pistol steady rest which also may double as a walking staff wherein a slender, rigid, telescopically-adjustable support rod is provided with a knurled hand grip adjacent its upper end and mounted in said upper end is a replaceable hard nylon pistol barrel support member comprising a cylindrical deformable plastic plug having its lower end screwably attached to said rod and having a recessed groove in its upper surface to snugly receive and support a pistol barrel. Grasping the knurled hand grip allows the shooter to steady the wrist of the hand grasping the hand grip while the other hand deploys the pistol barrel in the recessed groove and braces atop the wrist of the first hand to provide a rigid pistol firing position.

1 Claim, 4 Drawing Sheets

PISTOL REST

BACKGROUND OF THE INVENTION

1. Field of the Invention

The present invention relates to firearm steady rests and more particularly pertains to such a steady rest which is designed for pistol shooting.

2. Description of the Prior Art

The use of steady rests is known in the prior art going back to supports for the old match lock rifles. More specifically, modern steady rests heretofore devised and utilized for the purpose of providing more accuracy for firearms are known to consist basically of familiar, expected and obvious structural configurations, notwithstanding the myriad of designs encompassed by the crowded prior art which have been developed for the fulfillment of countless objectives and requirements. Most of such steady rests have been specifically designed for long barrel rifles and the like, e.g. U.S. Pat. Nos. 4,393,614; 4,575,964; 4,345,398; and 4,676,021. U.S. Pat. No. 4,819,359 illustrates a bench rest for pistols.

In this respect, the rest according to the present invention substantially departs from the conventional concepts and designs of the prior art, and in so doing provides an apparatus primarily developed for the purpose of providing a means for holding a pistol steady during firing thereof.

Therefore, it can be appreciated that there exists a continuing need for new and improved firearm supports which can be utilized specifically for pistols. In this regard, the present invention substantially fulfills this need.

SUMMARY OF THE INVENTION

In view of the foregoing disadvantages inherent in the known types of firearm rests now present in the prior art, the present invention provides an improved rest construction wherein the same can be utilized specifically to steady pistols in a rapid and convenient manner. As such, the general purpose of the present invention, which will be described subsequently in greater detail, is to provide a new and improved pistol rest apparatus which has all the advantages of the prior art device and none of the disadvantages.

To attain this, the present invention essentially comprises a pistol steady rest which also may double as a walking staff wherein a slender, rigid, telescopically-adjustable support rod is provided with a knurled hand grip adjacent its upper end and mounted in said upper end is a replaceable hard nylon pistol barrel support member comprising a cylindrical deformable plastic plug having its lower end screwably attached to said rod and having a recessed groove in its upper surface to snugly receive and support a pistol barrel. Grasping the knurled hand grip allows the shooter to steady the wrist of the hand grasping the hand grip while the other hand deploys the pistol barrel in the recessed groove and braces atop the wrist of the first hand to provide a rigid pistol firing position.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved pistol rest which has all the advantages of the prior art devices and none of the disadvantages.

It is another object of the present invention to provide a new and improved pistol rest which may be easily and efficiently manufactured and marketed.

It is a further object of the present invention to provide a new and improved pistol rest which is of a durable and reliable construction.

An even further object of the present invention is to provide a new and improved pistol rest which is susceptible of a low cost of manufacture with regard to both materials and labor, and which accordingly is then susceptible of low prices of sale to the consuming public, thereby making such devices economically available to the buying public.

Still yet another object of the present invention is to provide a new and improved pistol rest which provides in the apparatuses of the prior art some of the advantages thereof, while simultaneously overcoming some of the disadvantages normally associated therewith.

Still another object of the present invention is to provide a new and improved steady rest specifically for pistols.

Yet another object of the present invention is to provide a new and improved pistol rest which may also be utilized as a walking staff.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
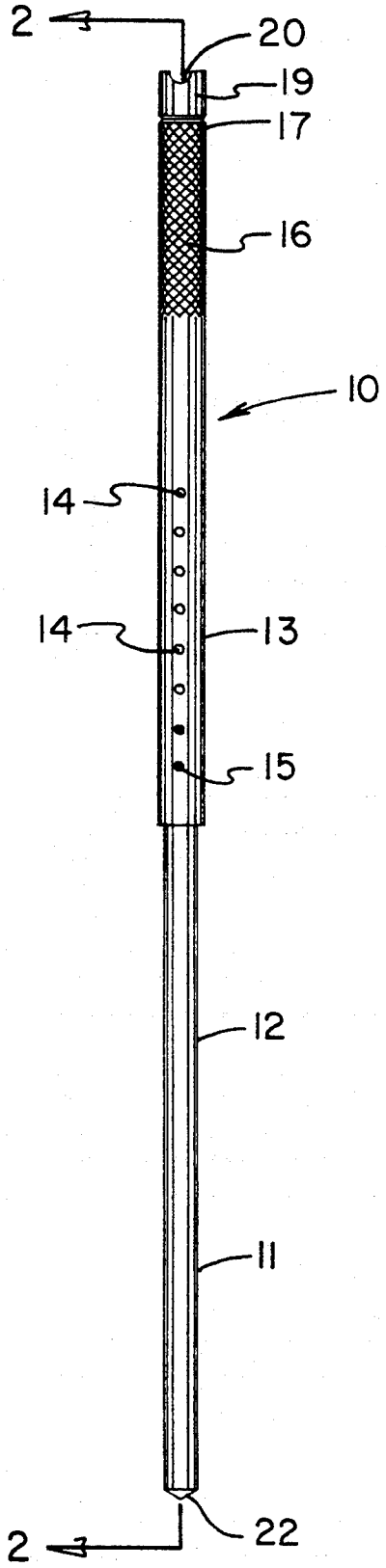
FIG. 1 is a front view of the device of the present invention.
Figure 2:
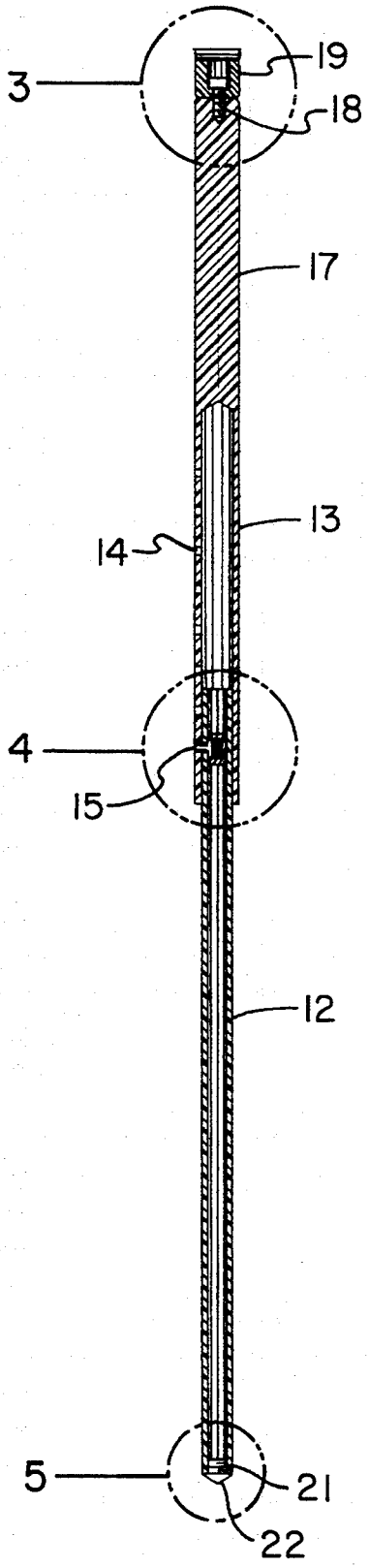
FIG. 2 is a sectional view on line 2—2 of FIG. 1.

With reference now to the drawings, and in particular to FIGS. 1 and 2 thereof, a new and improved pistol rest embodying the principles and concepts of the present invention and generally designated by the reference numeral 10 will be described.

More specifically, it will be noted that the pistol rest 10 consists of an elongated vertical support member 11 which is telescopic by virtue of being formed of two tubular sections 12 and 13, with section 13 slidable vertically over section 12. In order to fix such two sections 12 and 13 relative to one another, the overlying tubular section 13 is provided with a plurality of vertically spaced ports 14. Mounted in spring-loaded fashion in tubular section 12 and extendible therefrom is a detent pin member 15 adapted to engage in and extend through port 14 when a specific port is aligned with detent 15. Being spring-loaded, detent 15 may be pushed in to clear port 14 and tubular section then slid up or down to its desired height and the detent 15 re-engaged with another port 14. At the upper end of tubular section 13, a portion of the outer surface of section 13 is knurled to provide a non-slip hand grip 16. Sections 12 and 13 are preferably formed of light gauge hardened aluminum although a high density plastic may also be used. Inset in the closed upper end 17 of tubular member 13 as by a threaded bolt 18 is a deformable nylon pistol barrel-engaging block 19. Such block 19 has a small diameter recess 20 cast or machined therein of such dimension as to snugly engage a pistol barrel placed therein. Block 19 is replaceable to permit the use of wider or narrower recesses 20 as may be dictated by the diameter of the pistol barrel to be used therewith. The base end of the pistol rest 10 is formed by tubular section 12 and preferably terminates in a ground-engaging member 21 having a pointed external metal end 22 thereon.

Figure 3:
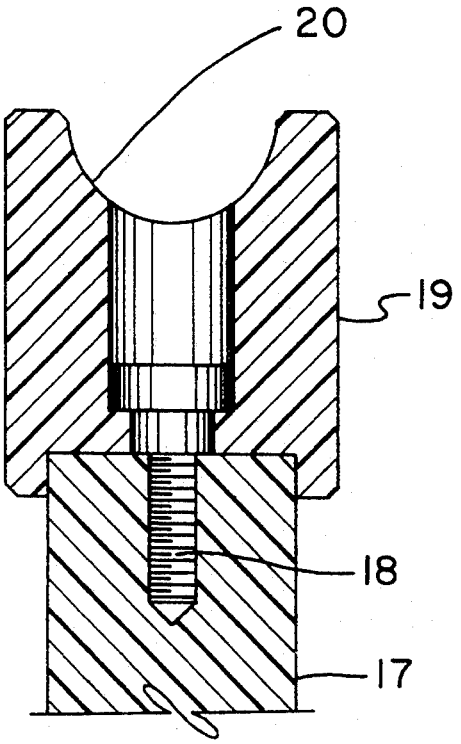
FIG. 3 is an enlarged sectional view of the area designated on FIG. 2 with a circled "3".

FIG. 3 shows in enlarged section the block 19 with its recess 20 and the threaded bolt 18 holding block 19 to the upper closed end 17 of tubular member 13. The closure 17 may be an inserted plug as shown in FIG. 2 or if the tubular member 13 is formed of rigid plastic, the end 17 may be molded in place.

Figure 4:
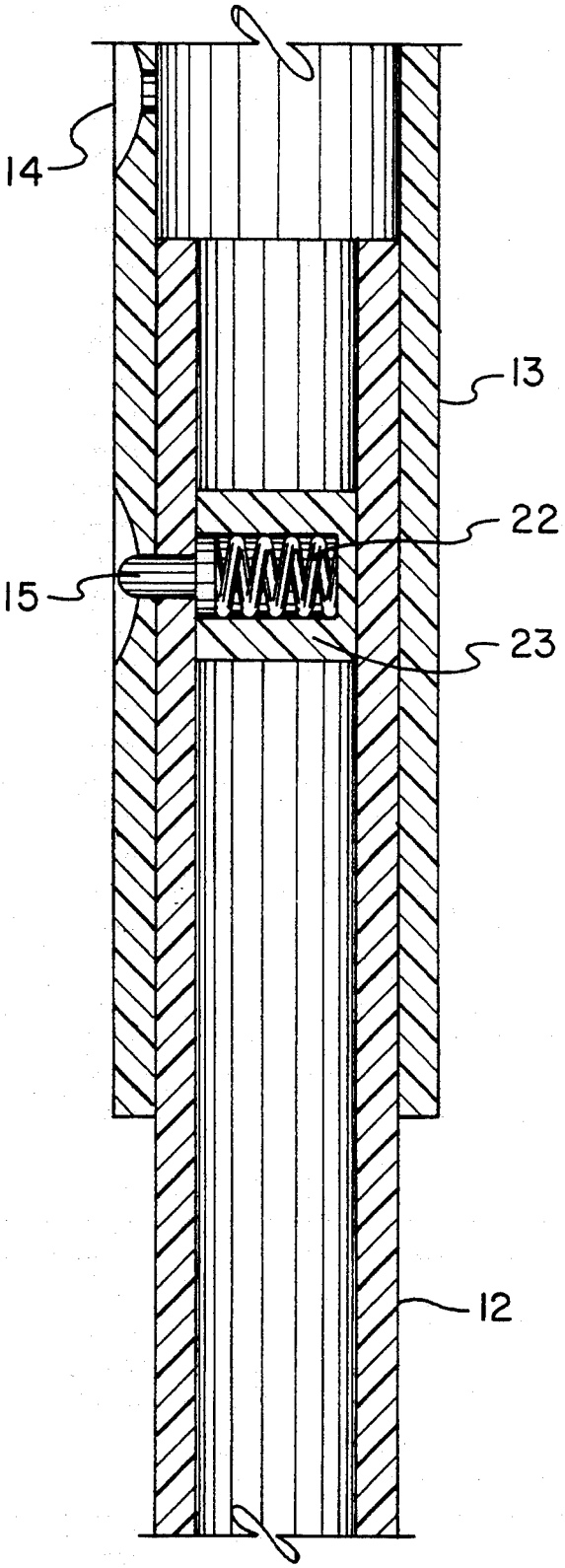
FIG. 4 is an enlarged sectional view of the area designated on FIG. 2 with a circled "4".

FIG. 4 shows in enlarged section the telescoping arrangement of sections 12 and 13 with the ports 14 extending through section 13. Positioned within section 12 is the detent member 15 adapted to engage with ports 14. Such detent member 15 is spring-loaded as at 22 and is mounted in a fixed block 23 positioned within section 12.

Figure 5:
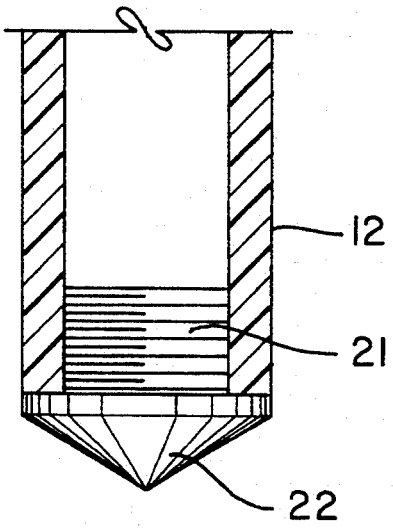
FIG. 5 is an enlarged sectional view of the area designated on FIG. 2 with a circled "5".

FIG. 5 shows, in similarly enlarged section, the detail of the base of tubular section 12, showing the ground-engaging member 21 threaded into section 12 with a pointed external end 22 thereon.

Figure 6:
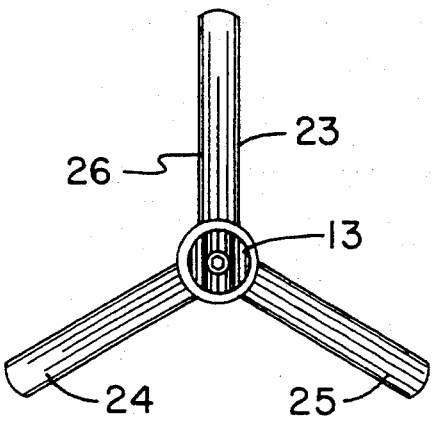
FIG. 6 is a top view shown in a modification to the base of the device of FIG. 1.
Figure 7:
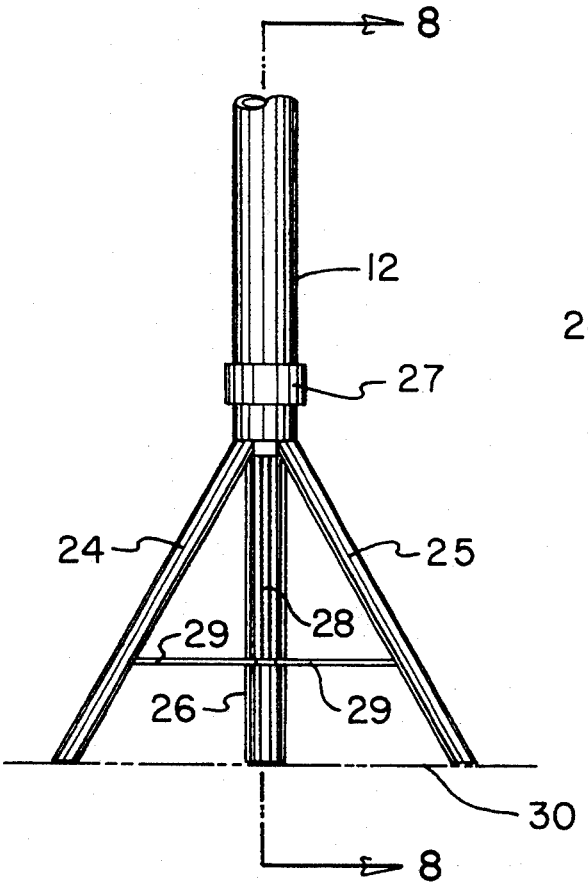
FIG. 7 is a front view of the modification shown in FIG. 6.

While FIGS. 1 through 5 illustrate the preferred embodiment of the pistol rest 10, a modification as shown in FIGS. 6 through 10 may be employed where increased steadiness is desired for the rest 10. This consists of modifying the base of tubular section 12 to provide a foldable tripod base 23 therefor. Such base 23 as shown in FIGS. 6 and 7 consists of three legs 24, 25 and 26 which unfold from their closed position (forming an extension of tubular section 12) when a retaining slidable collar 27 surrounding them is raised. Positioned in the center thereof and axial with tubular member 12 is a spring-loaded brace rod 28 which has affixed thereto three foldable braces 29 normally hinged at rod 28 but foldable down to extend to and engage with each of legs 24, 25 and 26. The lower end of rod 28 will engage with the ground or other surface 30 on which the tripod base 23 is deployed. Being spring-loaded, rod 28 will self-adjust to ground irregularities as it contacts the surface centrally of tripod 23.

Figure 8:
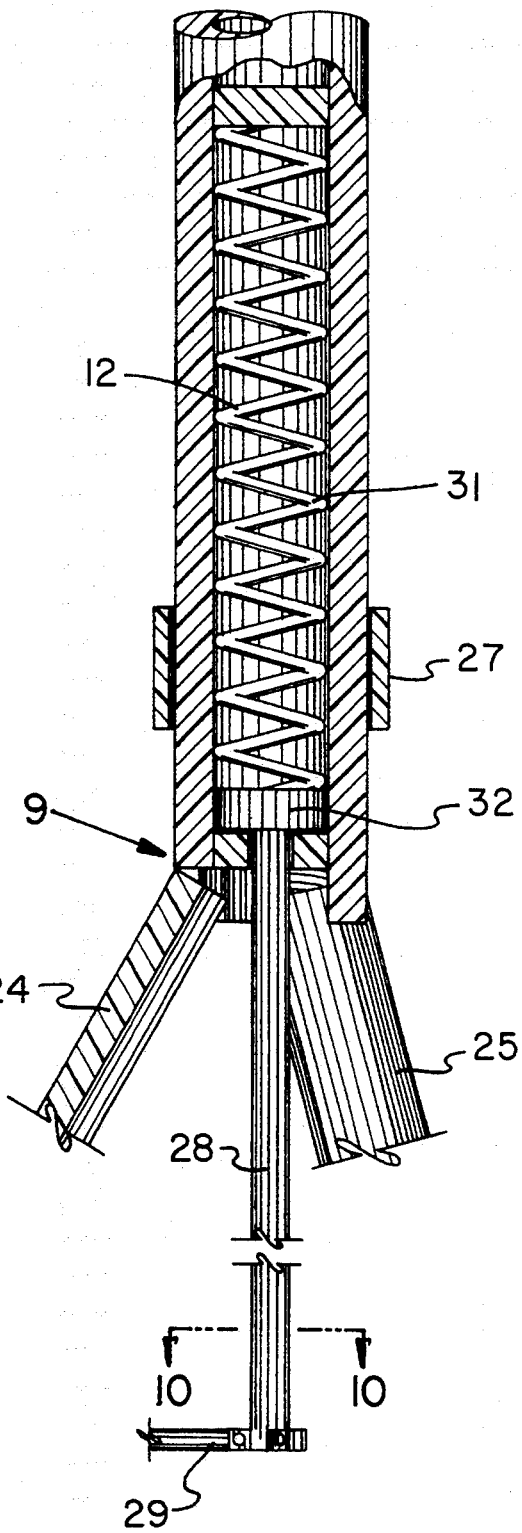
FIG. 8 is a partially sectional and enlarged view on line 8—8 of FIG. 7.

As shown in the detail sectional view of FIG. 8, the legs 24, 25 and 26 are hingedly mounted to tubular section 12 (as shown in detail in FIG. 9), while the central brace rod 28 extends from tubular member 12 under the influence of spring 31 engaging with a flange 32 at the upper end of rod 28.

Figure 9:
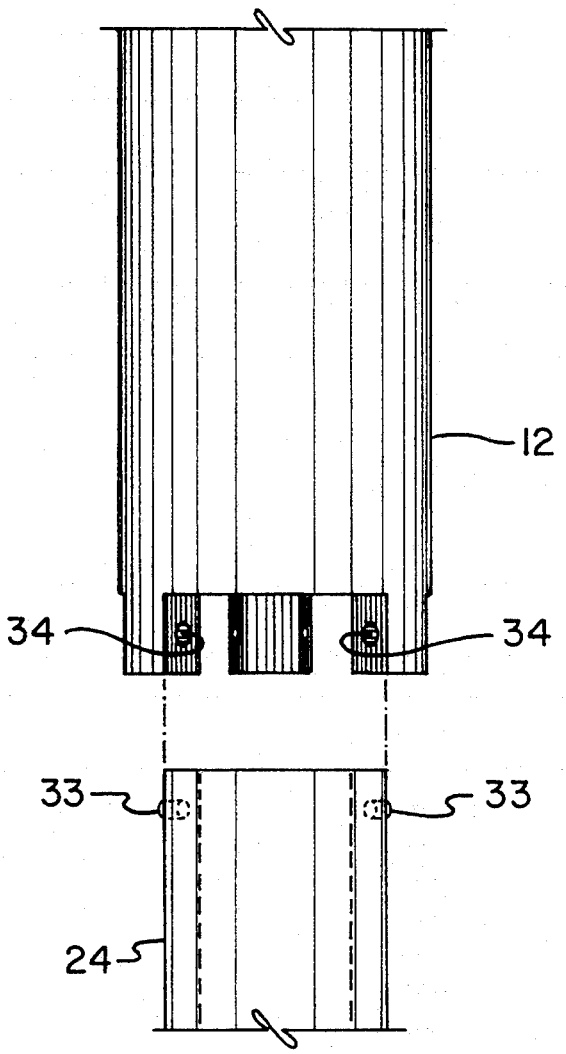
FIG. 9 is an enlarged and exploded view taken at "9" on FIG. 8.

As shown in FIG. 9, each of the three tripod legs, e.g. 24, is hinged by a pair of detent hinge pins 33 which engage with and pivot in corresponding holes 34 in tubular section 12. The engagement of the upper end of such legs with tubular section 12 prevent, such legs from extending too far from such section 12.

Figure 10:
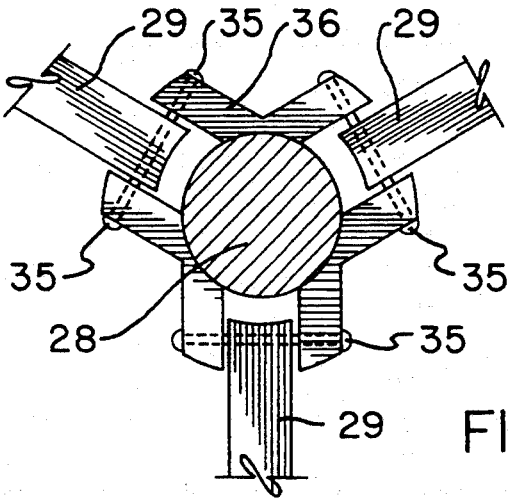
FIG. 10 is a top view taken on line 10—10 of FIG. 8.

FIG. 10 illustrates the connection of folding braces 29 to brace rod 28. Braces 29 abut brace rod 28 at their inner ends and are hingedly mounted thereto by hinged pins 35 positioned within a fixture 36 mounted around rod 28.

In use, the pistol rest 10 is grasped at the knurled hand hold which also serves when the unit is used as a walking staff. The pistol to be fired has the barrel thereof engaged with the recess within the top block and the shooter's wrist rests upon the other hand holding the pistol rest grip to provide a steady rest far superior to the traditional two-hand grip only.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A pistol rest comprising a slender, rigid telescopically-adjustable support rod; a knurled hand grip on said rod extending around an upper end thereof; and a cylindrical, deformable plastic plug replaceably screwed into the upper end of said rod, said plug having a recessed groove in its upper surface to snugly receive and support a pistol barrel, wherein the lower end of said rod terminates in a foldable tripod leg member having a plurality of legs, the tripod leg member including a spring biased rod telescopingly received within a lower end of said support rod, said spring biased rod having a fixture secured thereto, with a plurality of braces pivotally mounted to said fixture and to said legs to maintain said legs in a spread configuration when the spring biased rod is extended from the support rod.

* * * * *